US007600385B2

(12) United States Patent
Yan

(10) Patent No.: US 7,600,385 B2
(45) Date of Patent: Oct. 13, 2009

(54) PULSE TUBE CRYOGENIC COOLER

(75) Inventor: Pengda Yan, Tokyo (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 437 days.

(21) Appl. No.: 11/526,750

(22) Filed: Sep. 26, 2006

(65) Prior Publication Data

US 2007/0119190 A1 May 31, 2007

(30) Foreign Application Priority Data

Mar. 30, 2005 (JP) ..... 2005-099040

(51) Int. Cl.
*F25B 9/00* (2006.01)

(52) U.S. Cl. ..... 62/6

(58) Field of Classification Search ..... 62/6, 62/298

See application file for complete search history.

(56) References Cited

U.S. PATENT DOCUMENTS 4,501,120 A * 2/1985 Holland ..... 62/6
4,848,092 A * 7/1989 Gifford ..... 62/6
5,469,709 A * 11/1995 Lee ..... 62/6
6,343,475 B1 * 2/2002 Ishikawa ..... 62/6
6,715,300 B2 * 4/2004 Longsworth ..... 62/6
2004/0261423 A1 * 12/2004 Longsworth ..... 62/55.5

FOREIGN PATENT DOCUMENTS

JP 48-100236 11/1973
JP 59-71077 5/1984
JP 2001-165517 A 6/2001
JP 2004-144431 A 5/2004
JP 2004-293998 A 10/2004

OTHER PUBLICATIONS

JPO Office Action, App. No. 2005-099040, Jun. 2, 2009 (2 pages).

* cited by examiner

*Primary Examiner*—William C Doerrler
(74) *Attorney, Agent, or Firm*—Rader, Fishman & Grauer, PLLC

(57) ABSTRACT

A pulse tube cryogenic cooler, includes a cold storage device cartridge whose high temperature end is connected to a pressure change source; a pulse tube whose low temperature end is connected to a low temperature end of the cold storage device cartridge via a stage member; a phase adjusting mechanism connected to a high temperature end of the pulse tube; a flange where the phase adjusting mechanism is provided; and a cold storage device cylinder provided between the flange and the stage member, the cold storage device receiving the cold storage device cartridge.

7 Claims, 7 Drawing Sheets

PULSE TUBE CRYOGENIC COOLER

BACKGROUND OF THE INVENTION

1. Field of the Invention

The present invention generally relates to pulse tube cryogenic coolers. More particularly, the present invention relates to a pulse tube cryogenic cooler using a cold storage device cartridge.

2. Description of the Related Art

Generally, a pulse tube cryogenic cooler consisted of a pressure vibration generating device, a cold storage device, a pulse tube, a phase control mechanism, and others. Such a pulse tube cryogenic cooler is quieter than a Gifford McMahon (GM) cryogenic cooler or a Stirling type cryogenic cooler. Therefore, application of the pulse tube cryogenic cooler as a cooling device of various test or analyzing devices such as an electron microscope or a Nuclear Magnetic Resonance (NMR) apparatus has been expected.

FIG. 1 is a structural view of a pulse tube cryogenic cooler of a first related art cases.

Referring to FIG. 1, a pulse tube cryogenic cooler of a first related art case includes a helium compressor 1, a cold storage device 2, a switching valve 3, a phase adjusting mechanism 5, a pulse tube 6, a vacuum flange 7, a cold stage 8, and others.

The helium compressor 1 and the switching valve 3 work as a pressure vibration generating device configured to make helium gas as operation gas generate pressure vibration. The helium compressor 1 and the switching valve 3 are connected to a high temperature end of the cold storage device 2 via a pipe 16.

The switching valve 3 performs a switching operation at a designated cycle so that helium gas having a high pressure and generated by the helium compressor 1 is supplied to the cold storage device 2 at a designated cycle.

The cold storage device 2 is formed by a cold storage device cylinder 10 and a cold storage material 9. The cold storage device cylinder 10 is provided between the vacuum flange 7 and the cold stage 8. The cold storage material 9 is received in the cold storage device cylinder 10.

As the cold storage material 9, for example, a metal fiber or punched metal made of copper, stainless material, or the like may be used. The cold storage material 9 fills the cold storage device cylinder 10 at a designated density.

The operation gas supplied from the helium compressor 1 performs heat exchange with the cold storage material 9 in a period during which the operation gas passes through the cold storage device 2 so that cold storage is performed by the cold storage material 9.

The pulse tube 6 is also provided between the vacuum flange 7 and the cold stage 8. A low temperature end heat exchanger 11 in which a rectifier is provided is provided at a low temperature end of the pulse tube 6. A high temperature end heat exchanger 12 in which a rectifier is provided is provided at a high temperature end of the pulse tube 6.

In addition, a low temperature end of the cold storage device 2 and a low temperature end of the pulse tube 6 are connected by a piercing path 4 formed in the cold stage 8. In the cold storage device 2 and the pulse tube 6, an end part in a direction shown by an arrow X1 in FIG. 1 is a high temperature end. An end part in a direction shown by an arrow X2 in FIG. 1 is a low temperature end.

The phase adjusting mechanism 5 is provided at an upper part of the vacuum flange 7. In addition to the pipe 16, an orifice, a buffer tank, or the like is provided inside the phase adjusting mechanism 5. This orifice or the buffer tank is connected to the high temperature end of the pulse tube 6.

A bottom surface (hereinafter adjusting mechanism bottom surface 15) of the phase adjusting mechanism 5 is directly connected to the high temperature ends of the pulse tube 6 and the cold storage device 2. Therefore, pressure of the operation gas is directly applied. Because of this, the phase adjusting mechanism 5 is tightly fixed to the vacuum flange 7 by using bolts 13.

In addition, a shield member 17 is provided between a flange upper surface 14 and the adjusting mechanism bottom surface 15. The flange upper surface 14 is an upper surface of the vacuum flange. The shield member 17 prevents leakage of the operation gas.

In the above-discussed pulse tube cryogenic cooler, when an operation mode is started, the switching valve is switched so that helium gas compressed by the compressor 1 and having a high pressure flows into the cold storage device 2.

The helium gas flowing in the cold storage device 2 is cooled by the cold storage material 9 provided in the cold storage device 2 so that temperature of the helium gas is decreased. The helium gas flows from the low temperature end of the cold storage device 2 to the low temperature end heat exchanger 11 so as to be further cooled and flows into the pulse tube 6.

Gas having low pressure and already existing in the pulse tube 6 is compressed by the operation gas newly flowing in. Therefore, pressure in the pulse tube 6 becomes higher than pressure in the buffer tank provided in the phase adjusting mechanism 5. Because of this, the operation gas in the pulse tube 6 flows into the buffer tank via the orifice provided in the phase adjusting mechanism 5.

In a receiving mode where the helium has flowed into the pulse tube 6 and the cold storage device 2 is received by the helium compressor 1, the switching valve 3 is switched. As a result of this, the operation gas in the pulse tube 6 flows back into the low temperature end of the cold storage device 2, passes through the cold storage device 2, and is received at the compressor 1 via the high temperature end and the pipe 16.

As discussed above, the phase adjusting mechanism 5 connected to the high temperature end of the pulse tube 6 has the buffer tank and the orifice connected to the pulse tube 6. Because of this, the phase of pressure change and the phase of volume change of the operation gas occur with a constant phase difference.

Due to the phase difference, a cold state as the operation gas is expanded at the low temperature end of the pulse tube 6 is generated. By repeating the above- discussed steps, the pulse tube cryogenic cooler works as a cryogenic cooler.

However, the pulse tube cryogenic cooler shown in FIG. 1 has an integral structure where the cold storage material 9 is directly stuffed into the cold storage device cylinder 10. Accordingly, at the time when the pulse tube cryogenic cooler is operated, if contaminants such as liquid like moisture or the like in helium gas is frozen, loading or blocking may occur in the cold storage material 19. This may cause degradation of cooling ability.

In this case, the temperature of the frozen liquid is increased so that such a frozen liquid may be removed. However, if the contaminants are, for example, oil from the helium compressor 1, even if the temperature of the contaminants is increased, it is difficult to remove the contaminants and therefore it is necessary to exchange the cold storage material 9.

For implementing this maintenance, it is necessary to remove the pulse tube cryogenic cooler from a subject of cooling (not shown in FIG. 1) and exchange the cold storage material 9 for a new one. This causes decrease of an activity rate. In addition, it is necessary to implement a cooling operation again after the cold storage material 9 is changed to the new one. This operation causes increase of cost and time.

In order to solve the above-discussed problem, for example, a pulse tube cryogenic cooler wherein the cold storage material 9 is received in a cold storage device cartridge and this cold storage device cartridge is attached to or detached from the cold storage device cylinder 10 so that cold maintenance can be realized, is suggested in Japanese Laid-Open Patent Application Publication No. 2001-165517.

FIG. 2 is a structural view of a pulse tube cryogenic cooler of a second related art case using a cold storage device 18. In FIG. 2, parts that are the same as the parts shown in FIG. 1 are given the same reference numerals, and explanation thereof is omitted.

The cold storage device cartridge 18 has a closed-end cylindrical shape. The cold storage material 9 fills the inside of the cold storage device cartridge 18.

An opening part 18A is formed in a bottom part 18B of the cold storage device cartridge 18. Therefore, helium gas can flows to or from the pulse tube 6 via the piercing path 4. In addition, a designated gap is formed between the bottom part 18B of the cold storage device cartridge 18 and a container bottom surface 19 of the cold storage device cylinder 10.

However, in the related art cold storage device cartridge type pulse tube cryogenic cooler, in a case where the pressure of helium gas in the cold storage device 2 is increased, the inside of the cold storage device cylinder 10 is connected to the cold storage device cartridge 18 via the opening part 18A.

Because of this, as shown in FIG. 4(A), the pressure of helium gas supplied from the helium compressor 1 is applied to an entire surface of the container bottom surface 19 of the cold storage device cylinder 10.

A force F1 received by the container bottom surface 19 is defined as F1=P×S1, wherein a pressure per a unit area in the cold storage device is "P" and a cross-sectional area of the container bottom surface 19 shown in a dotted manner in FIG. 4(B) is "S1".

Here, FIG. 4 is a view of a cold storage device cartridge of the pulse tube cryogenic cooler of the second related art cases. More specifically, FIG. 4(A) is an enlarged view of the vicinity of a low temperature end of the cold storage device cartridge and FIG. 4(B) is a cross-sectional view taken along line A-A in FIG. 4(A).

Thus, in the related art cold pulse tube cryogenic cooler, since a pressure receiving area of helium gas (operation gas) in the container bottom surface 19 is large, the force F1 received by the container bottom surface 19 is large.

This force F1 is applied so that the cold stage 8 and the cold storage device cylinder 10 are separated from the phase adjusting mechanism 5. Therefore, the state shown in FIG. 3 is generated in the related art cold pulse tube cryogenic cooler. Here, FIG. 3 is a structural view of the pulse tube cryogenic cooler of the second related art case and shows a state where a vacuum flange is deformed.

As shown in FIG. 3, accompanying an alternating pressure change of helium gas in the cold storage device 2, the cold storage device 2 and the cold stage 8 are deformed alternating in directions shown by arrows X1 and X2. This causes generation of vibration in the pulse tube cryogenic cooler.

SUMMARY OF THE INVENTION

Accordingly, embodiments of the present invention may provide a novel and useful pulse tube cryogenic cooler, in which one or more of the problems described above are eliminated.

More specifically, the embodiments of the present invention may provide a pulse tube cryogenic cooler whereby vibration is prevented from being generated in the cold storage device cylinder and the stage member even if the cold storage device cartridge is provided in the cold storage device cylinder.

The embodiments of the present invention may also provide a pulse tube cryogenic cooler, including:

a cold storage device cartridge whose high temperature end is connected to a pressure change source;

a pulse tube whose low temperature end is connected to a low temperature end of the cold storage device cartridge via a stage member;

a phase adjusting mechanism connected to a high temperature end of the pulse tube;

a flange where the phase adjusting mechanism is provided; and a cold storage device cylinder provided between the flange and the stage member, the cold storage device receiving the cold storage device cartridge;

wherein a projection part where a connection hole configured to connect with the pulse tube is formed is provided at the low temperature end of the cold storage device cartridge so as to project to the stage member;

an installing concave part where the projection part is movably installed is formed in the stage member; and a cross-sectional area of the installing concave part is smaller than a cross-sectional area of the cold storage device cartridge.

According to the above-mentioned pulse tube cryogenic cooler of the embodiments of the present invention, an area where the pressure of operation gas is applied to the stage member is smaller than that of the related art. Therefore, a force configured to deform the flange is small. Hence, it is possible to prevent vibration from being generated in the pulse tube cryogenic cooler.

Other objects, features, and advantages of the present invention will become more apparent from the following detailed description when read in conjunction with the accompanying drawings.

BRIEF DESCRIPTION OF THE DRAWINGS

(FIG. 4(A) is an enlarged view of a vicinity of a low temperature end of the cold storage device cartridge and FIG. 4(B) is a cross-sectional view taken along line A-A in FIG. 4(A).);

(FIG. 6(A) is an enlarged view of the vicinity of a low temperature end of the cold storage device cartridge and FIG. 6(B) is a cross-sectional view taken along line B-B in FIG. 6(A).)

DETAILED DESCRIPTION OF THE PREFERRED EMBODIMENT

A description will now be given, with reference to FIG. 5 through FIG. 7, of embodiments of the present invention.

First Embodiment

Figure 5:
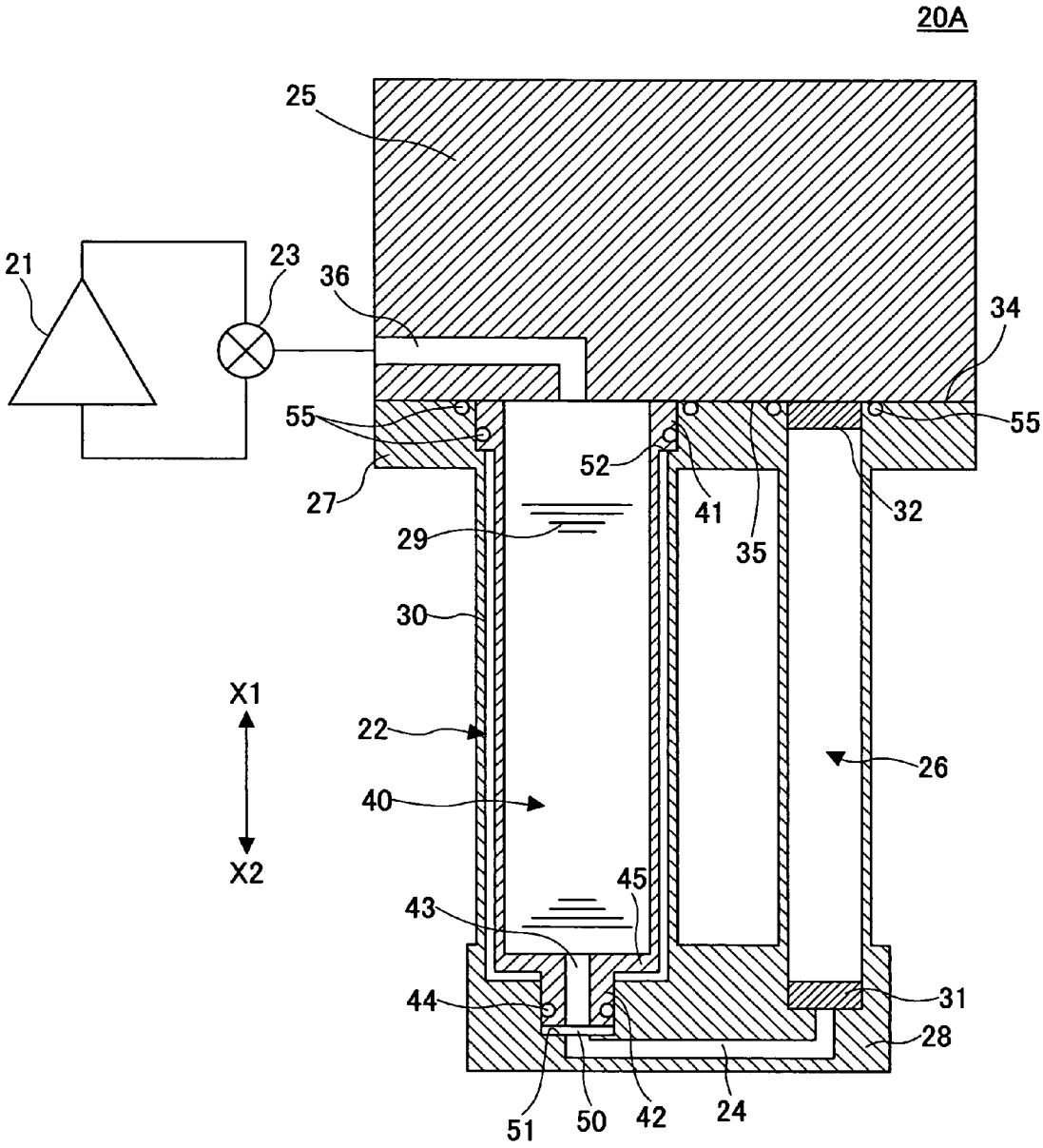
FIG. 5 is a structural view of a pulse tube cryogenic cooler of a first embodiment of the present invention.

FIG. 5 is a structural view of a pulse tube cryogenic cooler 20A of a first embodiment of the present invention.

Referring to FIG. 5, a pulse tube cryogenic cooler 20A of the first embodiment of the present invention includes a helium compressor 21, a cold storage device 22, a switching valve 23, a phase adjusting mechanism 25, a pulse tube 26, a vacuum flange 27, a cold stage 28, a cold storage device cartridge 40, and others.

The helium compressor 21 and the switching valve 23 work as a pressure vibration generating device configured to make helium gas as operation gas generate pressure vibration. The helium compressor 21 and the switching valve 23 are connected to a high temperature end of the cold storage device 22 via a pipe 36 formed in the phase adjusting mechanism 25.

The switching valve 23 performs a switching operation at a designated cycle so that helium gas having a high pressure and generated by the helium compressor 21 is supplied to the cold storage device 22 at a designated cycle.

The cold storage device 22 is formed by a cold storage device cylinder 30 and a cold storage cartridge 40. The cold storage device cylinder 30 is provided between the vacuum flange 27 and the cold stage 28. The cold storage cartridge 40 is received in the cold storage device cylinder 30.

The cold storage cartridge 40 can be attached to or detached from the cold storage device cylinder 30. The cold storage cartridge 40 has a closed-end cylindrical shape. A brim shaped engaging part 41 is formed at an upper end part of the cold storage device cylinder 30, namely an end part in the direction shown by an arrow X1.

A step part 52 is formed in a position of the vacuum flange 27 near the cold storage device cartridge 40. The step part 52 is engaged with the engaging part 41. Therefore, when the cold storage device cartridge 40 is inserted into the cold storage device cylinder 30, the engaging part 41 is engaged with the step part 52. In addition, in a state where the cold storage device cartridge 40 is inserted into the cold storage device cylinder 30, the upper end surface of the cold storage device cartridge 40 is situated at the substantially same position as the flange upper surface 34 of the vacuum flange 27.

Furthermore, in a state where the cold storage device cartridge 40 is inserted into the cold storage device cylinder 30, by providing the phase adjusting mechanism 25 at the vacuum flange 27, the cold storage device cartridge 40 is fixed in the cold storage device cylinder 30.

Sealing members 55 perform sealing between the side surface of the engaging part 41 and the cold stage 28 and between the phase adjusting mechanism 25 and the cold stage 28.

On the other hand, a projection part 42 is formed at the bottom part 45 of the cold storage device cartridge 40. The projection part 42 projects toward the cold stage 28, namely in a direction shown by an arrow X2 in FIG. 5. A connection hole 43 is formed in the center of the projection part 42 so as to pierce in upper and lower directions.

An installing concave part 50 is formed in the cold stage 28 so as to correspond to the projection part 42. The projection part 42 is inserted in the installing concave part 50 so as to be capable of moving in directions shown by arrows X1 and X2, namely, in a direction of vibration of the cold stage 28 and the cold storage device cylinder 30 as discussed below.

A cross-sectional area of the installing concave part 50 is smaller than a cross-sectional area of the cold storage device cartridge 40. Therefore, the cross-sectional area of the installing concave part 50 is smaller than a cross-sectional area of the cold storage device cylinder 30.

Where the projection part 42 is inserted in the installing concave part 50, in order to maintain a sealing state between the projection part 42 and the cold stage 28, a piston ring 44 is provided at the side surface of the projection part 42.

This piston ring 44 is made by forming resin having a rectangular shaped cross section in a ring shape and has extensiability and gas sealing ability. By providing the piston ring 44, while sealing is maintained with a simple structure, the projection part 42 can be moved against the installing concave part 50.

A cold storage material 29 is received in the cold storage device cartridge 40 having the structure discussed above. As the cold storage material 29, for example, a metal fiber or punched metal made of copper, stainless material, or the like may be used. The cold storage material 29 fills the cold storage device cylinder 40 at a designated density.

The operation gas supplied from the helium compressor 21 performs heat exchange with the cold storage material 29 in a period during which the operation gas passes through the cold storage device cartridge 40, thereby effecting the cold storage device 22 so that cold storage is performed by the cold storage material 29.

On the other hand, the pulse tube 26, as well as the cold storage device 22, is provided between the vacuum flange 27 and the cold stage 28.

A low temperature end heat exchanger 31 in which a rectifier is provided is provided at a low temperature end of the pulse tube 26. A high temperature end heat exchanger 32 in which a rectifier is provided is provided at a high temperature end of the pulse tube 26.

In addition, a low temperature end of the cold storage device 22 and a low temperature end of the pulse tube 26 are connected by a piercing path 24 formed in the cold stage 28. In the cold storage device 22 and the pulse tube 26, end parts in the direction shown by an arrow X1 in FIG. 5 are high temperature ends. End parts in the direction indicated by an arrow X2 in FIG. 5 are low temperature ends.

The cold storage device cylinder 30, the vacuum flange 27, the pulse tube 26 and the cold stage 28 are made of stainless. In addition, the cold storage device cylinder 30, the vacuum flange 27, and the cold stage 28 are formed in a body by using connection means such as welding.

In addition, the phase adjusting mechanism 25 is fixed at an upper part of the vacuum flange 27. In addition to the pipe 36 discussed above, an orifice, a buffer tank, or the like is provided inside the phase adjusting mechanism 25. This orifice or the buffer tank is connected to the high temperature end of the pulse tube 26. By fixing the phase adjusting mechanism 25 at the upper part of the vacuum flange 27, the flange upper surface 34 is adhered to the adjusting mechanism bottom surface 35.

In the above-discussed pulse tube cryogenic cooler 20A, when an operation mode is started, the switching valve 23 is switched so that helium gas compressed by the compressor 21 and having a high pressure flows into the cold storage device 22. As a result of this, helium gas compressed by the compressor 21 and having the high pressure flown into the cols storage device cartridge 40 of the cold storage device 22 via the pipe 36.

The helium gas flowing in the cold storage device cartridge 40 is cooled by the cold storage material 29 provided in the cold storage device cartridge 40 so that temperature of the helium gas is decreased. The helium gas flows from the connection hole 43 formed in the low temperature end of the cold storage device cartridge 40 to the installing concave part 50.

The installing concave part 50 is connected to the piercing path 24. Therefore, helium gas passes through the connection path 24 and flows into the low temperature end heat exchanger 31 so as to be further cooled and then flows into the pulse tube 26.

Gas having low pressure and already existing in the pulse tube 26 is compressed by helium gas newly flowing in. Therefore, the pressure in the pulse tube 26 becomes higher than the pressure in the buffer tank provided in the phase adjusting mechanism 25. Because of this, the operation gas in the pulse tube 26 flows into the buffer tank via the orifice provided in the phase adjusting mechanism 25.

On the other hand, when the switching valve 23 is switched so that a receiving mode is started where the helium in the pulse tube 26 and the cold storage device 22 is received by the helium compressor 21, the operation gas in the pulse tube 26 flows to the low temperature end of the cold storage device cartridge 40 via the piercing path 24, the installing concave part 50 and the connection hole 43. The operation gas passes through the cold storage device cartridge 40, and is received at the compressor 21 via the high temperature end of the cold storage device 22 and the pipe 36.

As discussed above, the phase adjusting mechanism 25 connected to the high temperature end of the pulse tube 26 has the buffer tank and the orifice connected to the pulse tube 26. Because of this, the phase of pressure change and the phase of volume change of the operation gas occur with a constant phase difference.

Due to the phase difference, a cold state is generated as the operation gas is expanded at the low temperature end of the pulse tube 26. By repeating the above-discussed steps, the pulse tube cryogenic cooler works as a cryogenic cooler.

Here, the pressure of helium gas applied between the projection part 42 formed in the cold storage device cartridge 40 and the installing concave part 50 in a case where the pressure of helium gas introduced to the cold storage device cartridge 40 is discussed with reference to FIG. 6.

Figure 6:
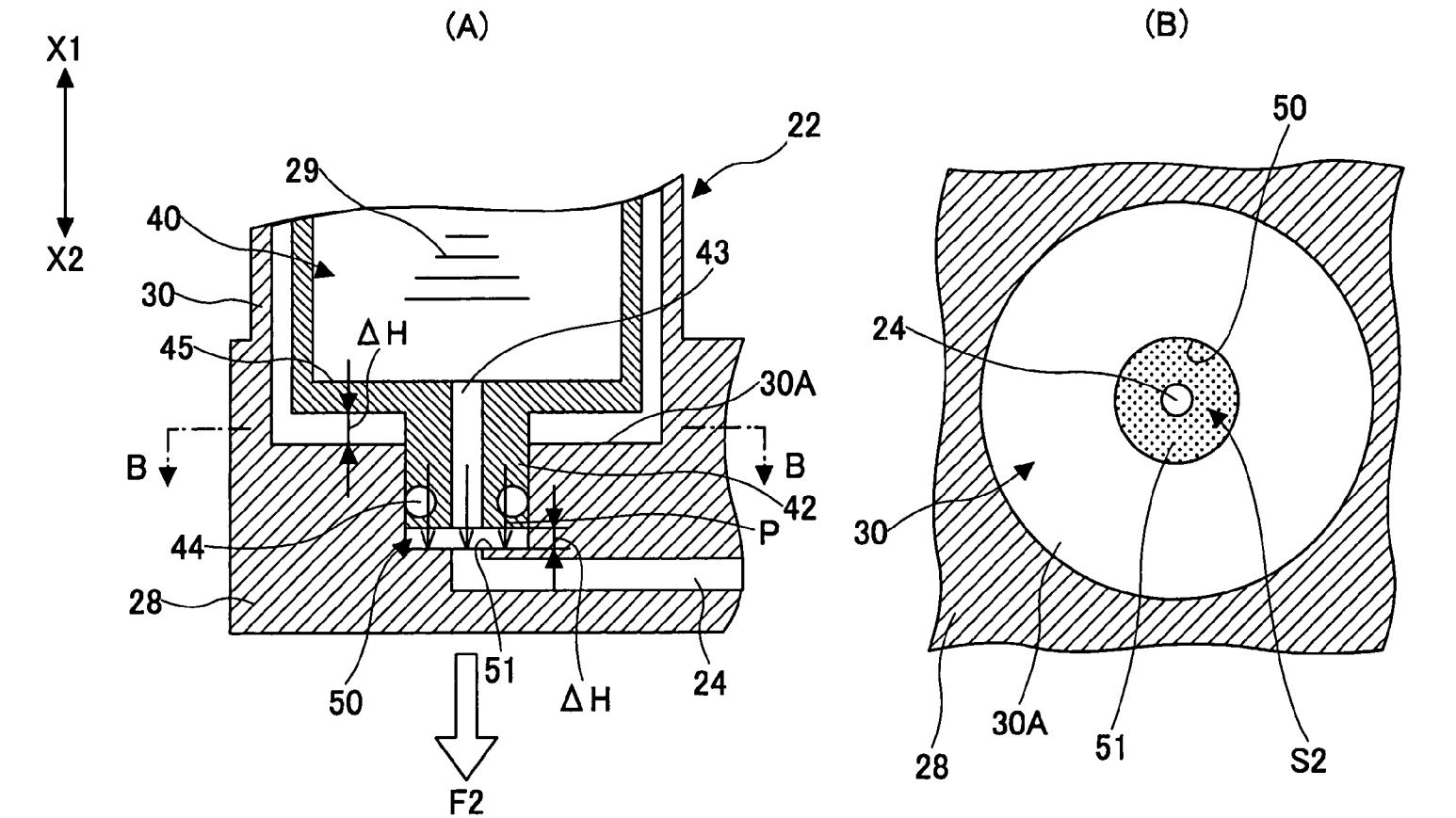
FIG. 6 is a view of a cold storage device cartridge of the pulse tube cryogenic cooler of the first embodiment of the present invention

FIG. 6 is a view of a cold storage device cartridge of the pulse tube cryogenic cooler of the first embodiment of the present invention. More specifically, FIG. 6(A) is an enlarged view of the vicinity of a low temperature end of the cold storage device cartridge and FIG. 6(B) is a cross-sectional view taken along line B-B in FIG. 6(A).

As discussed above, in the above-discussed pulse tube cryogenic cooler 20A, the projection part 42 where the connection hole 43 is formed is formed at the low temperature end of the cold storage device cartridge 40. The cold storage device cartridge 40 is movably installed to the installing concave part 50 formed in the cold stage 28.

Since the installing concave part 50 is connected to the cold storage device cartridge 40 via the connection hole 43, the pressure of helium gas introduced into the cold storage device cartridge 40 is applied to the installing concave part 50 via the connection hole 43.

Figure 1:
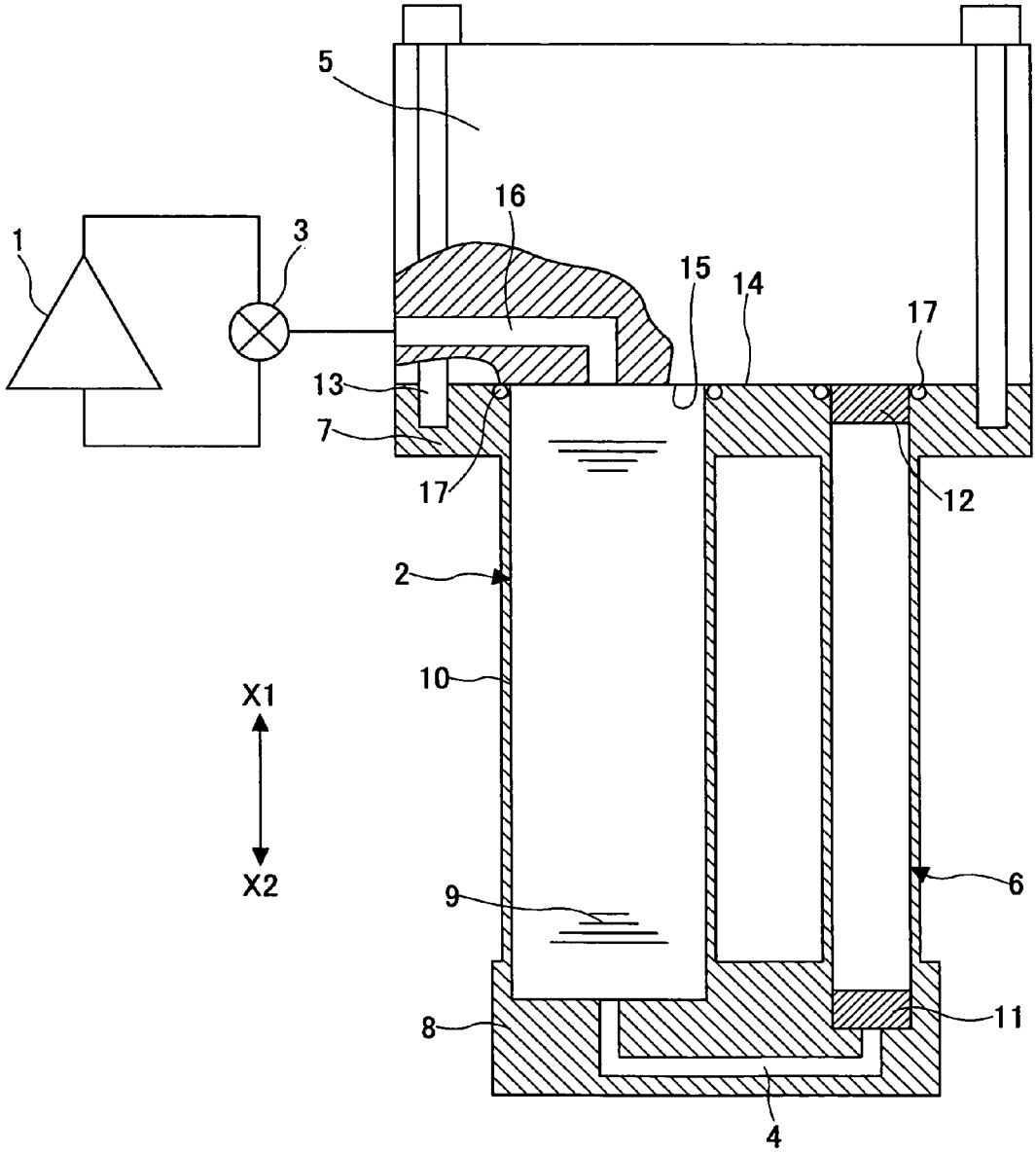
FIG.1 RELATED ART
FIG. 1 is a structural view of a pulse tube cryogenic cooler of a first related art case.
Figure 2:
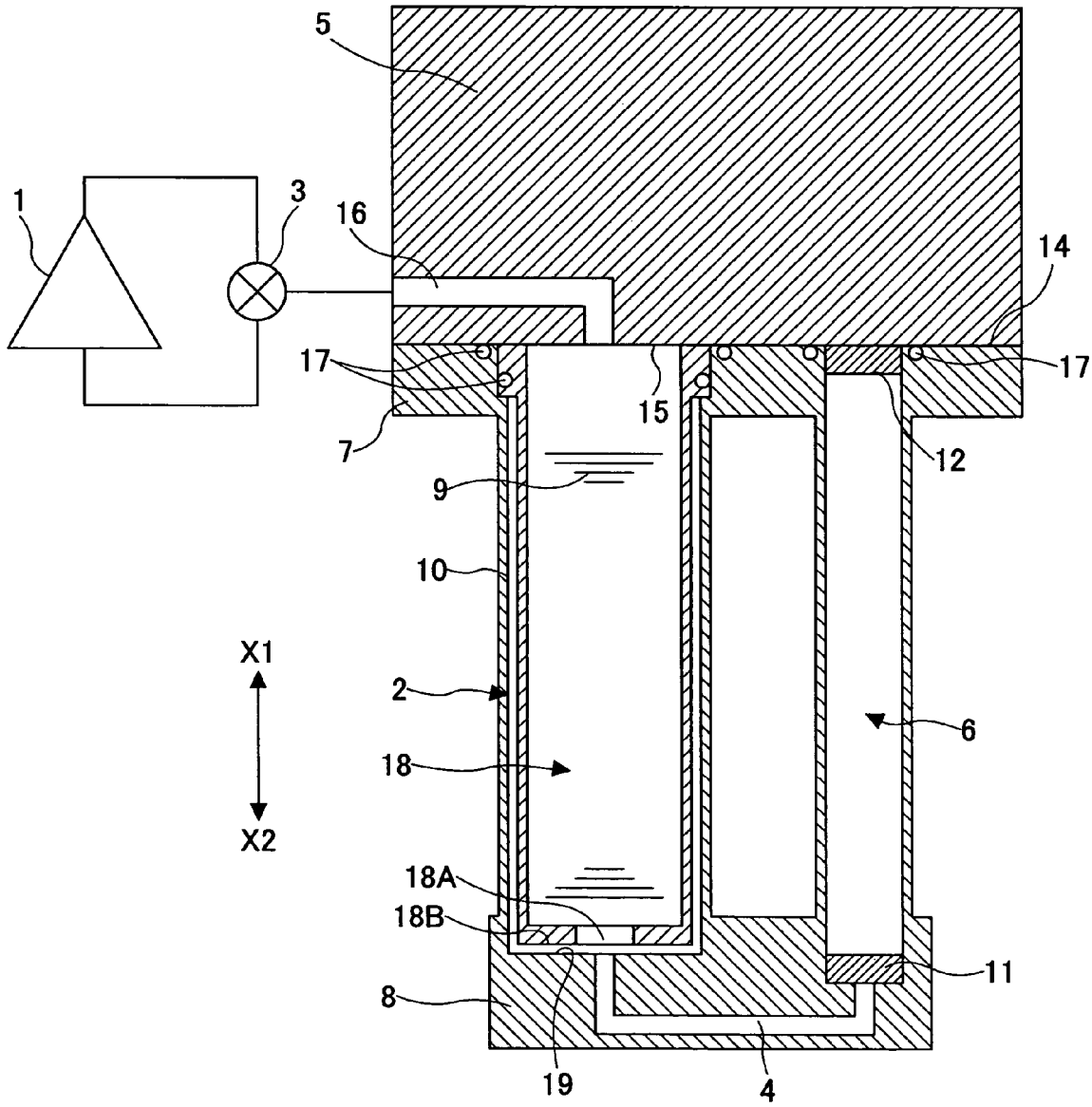
FIG.2 RELATED ART
FIG. 2 is a structural view of a pulse tube cryogenic cooler of a second related art case.
Figure 3:
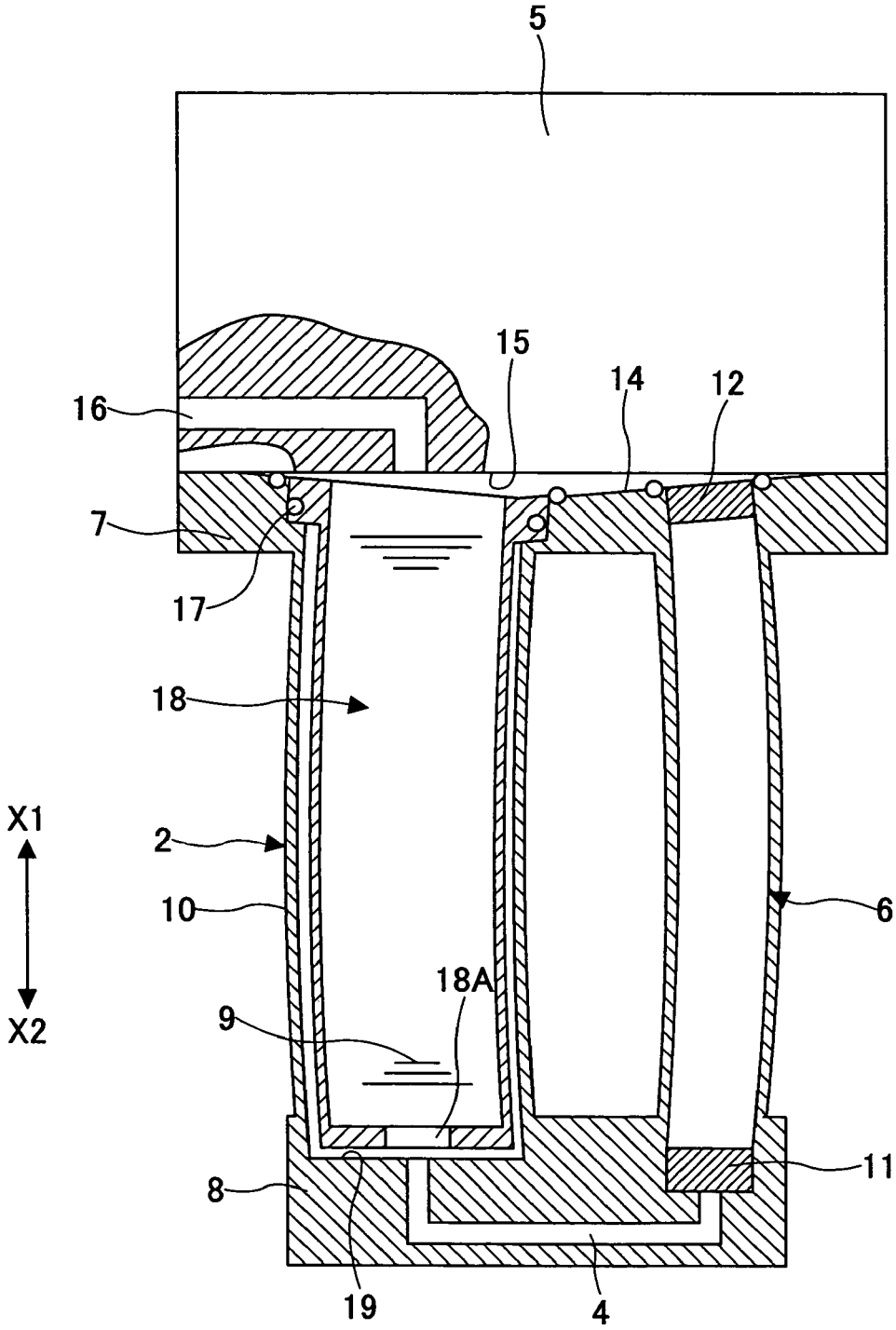
FIG.3 RELATED ART
FIG. 3 is a structural view of the pulse tube cryogenic cooler of the second related art case and shows a state where a vacuum flange is deformed.
Figure 4:
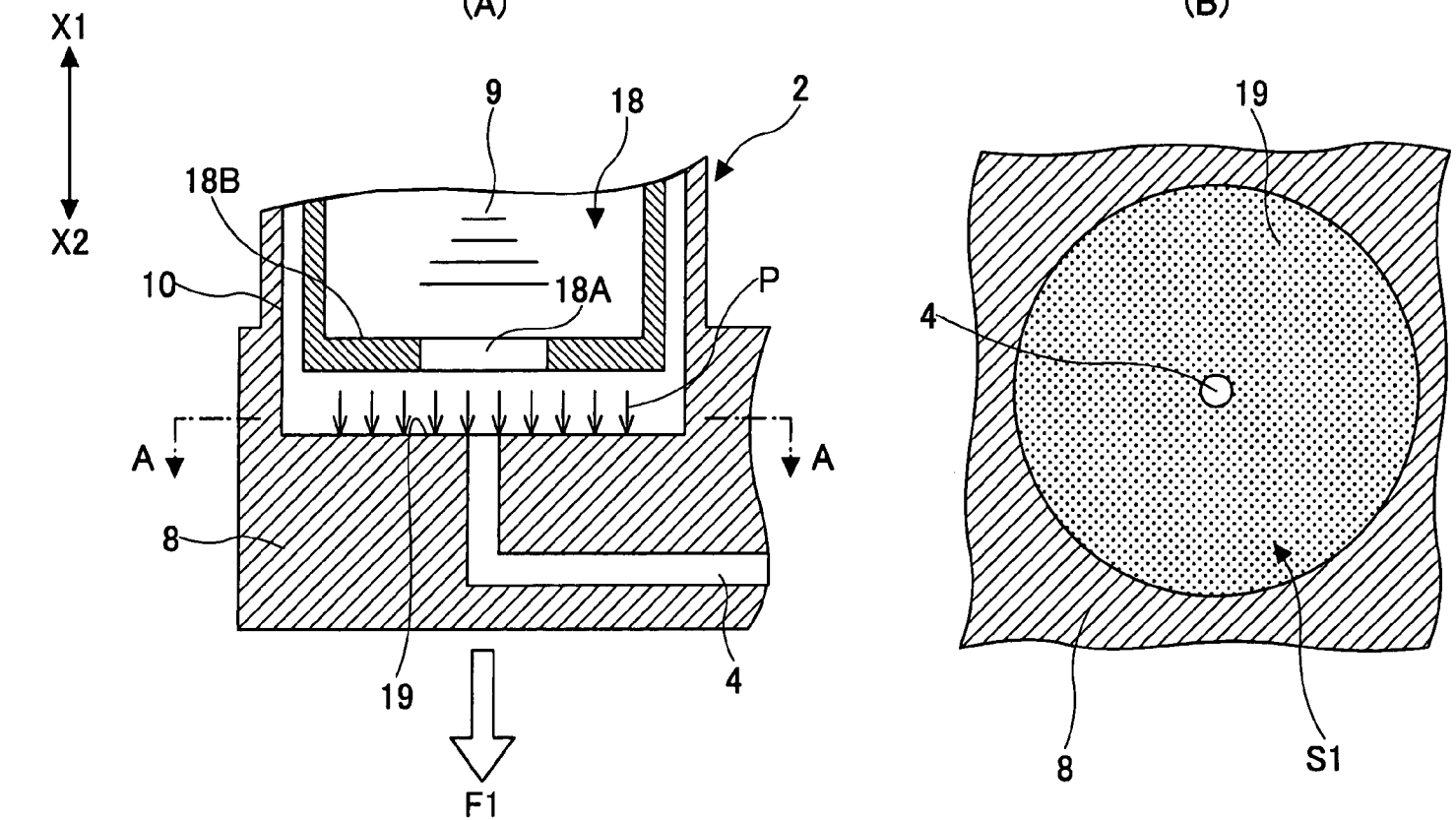
FIG.4 RELATED ART
FIG. 4 is a view of a cold storage device cartridge of the pulse tube cryogenic cooler of the second related art case

In the related art, as discussed above with reference to FIG. 4, the bottom part 18B of the cold storage device cartridge 18 is flat and only the opening part 18A is formed in the bottom part 18B.

Because of this, in the related art, the pressure of helium gas introduced to the cold storage device cartridge 18 is applied to the entire surface (the area S1) of the container bottom surface 19 of the cold storage device cylinder 10. Accordingly, a force F1 received by the container bottom surface 19 and making the cold stage 8 and the cold storage device cylinder 10 vibrate, is large and defined as F1=P×S1, wherein the pressure per a unit area in the cold storage device is "P" and a cross-sectional area of the container bottom surface 19 shown in a dotted manner in FIG. 4(B) is "S1".

On the other hand, in the above-discussed pulse tube cryogenic cooler 20A as shown in FIG. 6, the projection part 42 is installed in the bottom part 45 of the cold storage device cartridge 40. The projection part 42 can be moved in the installing concave part 50 formed in the cold stage 28 in a sealing state.

The external diameter of the projection part 42 is smaller than the diameter of the cold storage device cartridge 40 and the internal diameter of the installing concave part 50 is substantially the same as the external diameter of the projection part 45. Therefore, an area S2 of a concave part bottom surface 51 of the installing concave part 50 shown by dots in FIG. 6 is smaller than the cross-sectional area of the cold storage device cartridge 40.

Therefore, a force F2 configured to move the cold stage 28 in the direction shown by the arrow X2 by the pressure of helium gas introduced into the cold storage device cartridge 40 is defined as F2=P×S2, wherein the pressure (force per a unit area) in the cold storage device cartridge 40 is "P" and a pressure loss due to the piercing path 24 is disregarded.

The area S2 of the concave part bottom surface 51 is extremely smaller than the area S1 of the container bottom surface 19 where the pressure of helium gas is applied in the related art pulse tube cryogenic cooler (S2<S1).

Therefore, the force F2 configured to displace the cold stage 28 is smaller than that in the related art (F2<F1). Accordingly, a force configured to displace the cold stage 28 is small and thereby vibration generated in the pulse tube cryogenic cooler can be prevented.

An effect of the pulse tube cryogenic cooler 20A of the first embodiment of the present invention is discussed below by comparing it to the related art.

Parameters of the related art pulse tube cryogenic cooler are set as follows. That is, the internal diameter of the cold storage device cylinder 10 is approximately 50 mm; the length of the cold storage device cylinder 10 is approximately 150 mm; the thickness of the cold storage device cylinder 10 is approximately 1 mm; the material of the cold storage device cylinder 10 is stainless; the pressure of the helium compressor 1 at the time of high pressure is approximately 2 MPa; and the pressure of the helium compressor 1 at the time of low pressure is approximately 0.8 MPa.

Calculation is made based on the above-mentioned conditions so that the following results are obtained. A force F1 received by the cold stage 8 at the time of high pressure is approximately 392 Kg; and a force F1 received by the cold stage 8 at the time of low pressure is approximately 157 Kg.

Therefore, the range of change of the force F1 applied to the cold stage 8 between the high pressure time and the low pressure time is approximately 235 Kg. Amplitude of displacement amount of the cold storage device cylinder 10 is approximately 12 μm. In other words, the amplitude in directions shown by arrows X1 and X2 of the cold stage 8 is approximately 12 μm.

On the other hand, in the pulse tube cryogenic cooler 20A of the first embodiment of the present invention, as discussed above, only the concave part bottom surface 51 of the installing concave part 50 receives pressure change. Other parts such as an inside wall of the cold storage device cartridge 40 receives a constant pressure. This constant pressure does not give influence to vibration of the cold stage 28.

Parameters of the pulse tube cryogenic cooler 20A of the first embodiment of the present invention are set as follows. That is, the internal diameter of the cold storage device cylinder 10 is approximately 50 mm; the external diameter of the cold storage device cartridge 40 is approximately 16 mm, the length of the cold storage device cylinder 10 is approximately 150 mm; the thickness of the cold storage device cylinder 10 is approximately 1 mm; the material of the cold storage device cylinder 10 is stainless; the pressure of the helium compressor 21 at the time of high pressure is approximately 2 MPa; the pressure of the helium compressor 21 at the time of low pressure is approximately 0.8 MPa; and an intermediate pressure is approximately 1.4 MPa.

Calculation is made based on the above-mentioned conditions so that the following results are obtained. A force F2 received by the cold stage 28 at the time of high pressure is approximately 315 Kg; and a force F2 received by the cold stage 28 at the time of low pressure is approximately 281 Kg.

Therefore, a range of change of the force F2 applied to the cold stage 28 between the high pressure time and the low pressure time is approximately 24 Kg. Amplitude of displacement amount of the cold storage device cylinder 10 is approximately 1.2 μm. In other words, the amplitude in directions shown by arrows X1 and X2 of the cold stage 28 is approximately 1.2 μm. Thus, the displacement amount (vibration) generated in the cold stage 28 is approximately one tenth of that in the related art.

On the other hand, when the pressure change of helium gas is generated as discussed above, relative displacement (displacement in directions shown by the arrows X1 and X2) is generated between the cold storage device cylinder 30 and the cold stage 28 and the cold storage device cartridge 40.

In order to absorb this relative displacement, in the pulse tube cryogenic cooler 20A of the first embodiment of the present invention, a designated clearance ΔH is formed between the bottom part 45 of the cold storage device cartridge 40 and the bottom surface 30A of the cold storage device cylinder 30 and between the head end part of the projection part 42 and the concave part bottom surface 51.

This clearance ΔH is larger than a maximum value of the above-mentioned relative displacement. Under this structure, even if the cold stage 28 and the cold storage device cylinder 30 are relatively displaced from the cold storage device cartridge 40 by the pressure of helium gas, the cold stage 28 and the cold storage device cylinder 30 and the cold storage device cartridge 40 do not interfere with each other. It is preferable that the above-mentioned clearance ΔH be equal to or greater than approximately 500 μm and equal to or less than approximately 0.1 mm.

Second Embodiment

Figure 7:
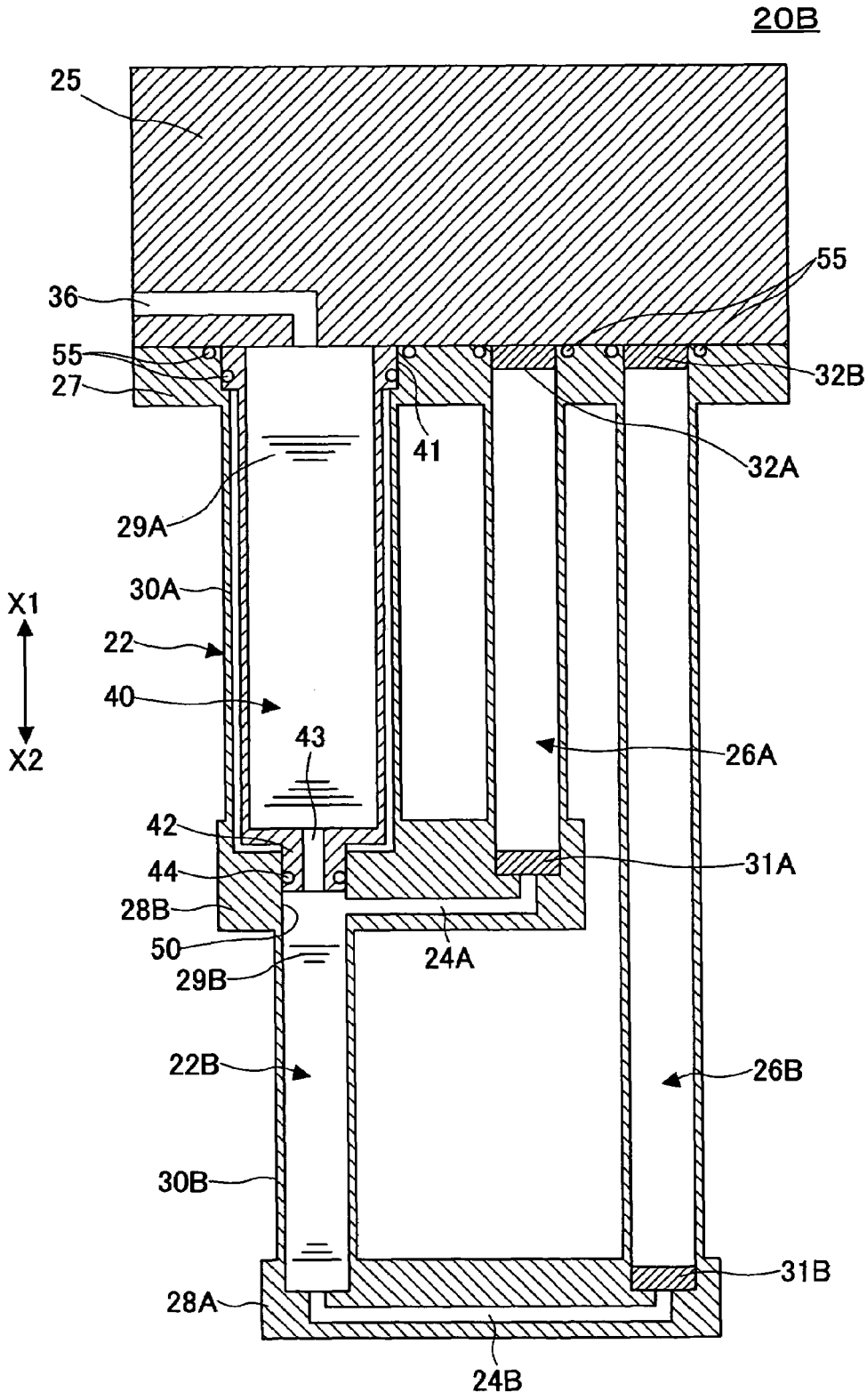
FIG. 7 is a structural view of a pulse tube cryogenic cooler of a second embodiment of the present invention.

FIG. 7 is a structural view of a pulse tube cryogenic cooler 20B of a second embodiment of the present invention. In FIG. 7, parts that are the same as the parts of the pulse tube cryogenic cooler 20A of the first embodiment of the present invention shown in FIG. 5 and FIG. 6 are given the same reference numerals, and explanation thereof is omitted.

The pulse tube cryogenic cooler 20B shown in FIG. 6 is a two-step double inlet type or 4-valve type pulse tube cryogenic cooler. Since this pulse tube cryogenic cooler 20B is a two steps type, the pulse tube cryogenic cooler 20B includes a first step cold storage device 22A and a second cold storage device 22B as cold storage devices. In addition, the pulse tube cryogenic cooler 20B includes a first step pulse tube 26A and a second step pulse tube 26B as pulse tubes.

A high temperature end of the first step cold storage device 22A and high temperature ends of the first and second step pulse tubes 26A and 26B are supported by the vacuum flange 27.

The first step cold storage device 22A is formed by a first step cold storage device cylinder 30A and a cold storage device cartridge 40. The first step cold storage device cylinder 30A is provided between the vacuum flange 27 and the cold stage 28B. The cold storage device cartridge 40 is received in the first step cold storage device cylinder 30A. The cold storage device cartridge 40 can be attached to or detached from the cold storage device cylinder 30A.

On the other hand, a projection part 42 is formed at the bottom part 45 of the cold storage device cartridge 40. The projection part 42 projects toward the cold stage 28B, namely in a direction shown by an arrow X2 in FIG. 7. A connection hole 43 is formed in the center of the projection part 42 so as to pierce in upper and lower directions.

An installing concave part 50 is formed in the cold stage 28B so as to correspond to the projection part 42. The projection part 42 is inserted in the installing concave part 50 so as to be capable of moving in directions shown by arrows X1 and X2, namely, in directions of vibration of the cold stages 28A and 28B and the cold storage device cylinder 30 as discussed below.

A cross-sectional area of the installing concave part 50 is smaller than a cross-sectional area of the cold storage device cartridge 40. Therefore, the cross-sectional area of the installing concave part 50 is smaller than a cross-sectional area of the cold storage device cylinder 30A. In this example, the installing concave part 50 has the same internal diameter as the internal diameter of the second step cold storage device cylinder 30B forming the second step cold storage device 22B.

On the other hand, the first step cold storage device 22A and the second step cold storage device 22B are directly connected to each other.

In other words, the low temperature end (end part in a direction shown by the arrow X2) of the first step cold storage device 22A is connected to the high temperature end (end part in a direction shown by the arrow X1) of the second step cold storage device 22B. The low temperature end of the first step cold storage device 22A and the low temperature end of the first step pulse tube 26A are connected to each other by the first connection path 24A. The low temperature end of the second step cold storage device 22B and the low temperature end of the second step pulse tube 26B are connected to each other by the second connection path 24B.

In the above-discussed pulse tube cryogenic cooler 20B, when an operation mode is started, helium gas compressed by the compressor 21 and having a high pressure is flows into the cold storage device cartridge 40 of the first step cold storage device 22A via the pipe 36.

The helium gas flowing into the cold storage device cartridge 40 is cooled by the cold storage material 29A provided in the cold storage device cartridge 40 so that the temperature of the helium gas is decreased. A part of the helium gas flows from the connection hole 43 formed in the low temperature end of the cold storage device cartridge 40 to the lower end of the first step pulse tube 26A via the connection path 24A.

Helium gas having low pressure and already existing in the first pulse tube 26A is compressed by helium gas newly flowing in. Therefore, the pressure in the first pulse tube 26A becomes higher than the pressure in the buffer tank provided in the phase adjusting mechanism 25. Because of this, the helium gas in the first step pulse tube 26A flows into the first buffer tank via the orifice provided in the phase adjusting mechanism 25.

On the other hand, in the receiving mode, the helium gas in the first step pulse tube 26A flows into the first step cold storage device 22A, passes through the cold storage device cartridge 40, and is received in the compressor 21 via the high temperature end and the pipe 36.

As discussed above, by the phase adjusting mechanism 25, the phase of pressure change and the phase of volume change of the operation gas occur with a constant phase difference. Due to the phase difference, a cold state is generated as the helium gas is expanded at the low temperature end of the first step pulse tube 26A.

On the other hand, helium gas not flowing in the first step pulse tube 26A in the helium gas flowing from the helium compressor 21 to the cold storage device cartridge 40 in the operation mode flows from the cold storage device cartridge 40 (the first step cold storage device 22A) to the second step cold storage device 22B.

At this time, since helium gas cooled by the first step pulse tube 26A flows back into the low temperature end of the first step cold storage device 22A, this low temperature end is cooled.

Accordingly, the helium gas flown from the first step cold storage device 22A to the second step cold storage device 22B is cooled by the first step pulse tube 26A and flows into the high temperature end of the second step cold storage device 22B.

The helium gas flowing in the second step cold storage device 22B is cooled by the cold storage material 29B provided in the second cold storage device 22B so that the temperature of the helium gas is further decreased. The helium gas flows to the low temperature end, passes through the second connection path 24B formed in the second step cold stage 28A, and flows into the low temperature end of the second step pulse tube 26B.

Helium gas having low pressure and already existing in the second pulse tube 26B is compressed by helium gas newly flowing in. Therefore, the pressure in the second pulse tube 26B becomes higher than a pressure in the buffer tank provided in the phase adjusting mechanism 25. Because of this, the operation gas in the second step pulse tube 26B flows into the second buffer tank via the orifice provided in the phase adjusting mechanism 25.

On the other hand, in the receiving mode, the helium gas in the second step pulse tube 26B flows back into the low temperature end of the second step cold storage device 22B, passes through the cold storage device cartridge 40 of the first step cold storage device 22A, and is received from the high temperature end of the compressor 21.

As discussed above, by the phase adjusting mechanism 25, the phase of pressure change and the phase of volume change of the operation gas occur with a constant phase difference. Due to the phase difference, a cold state is generated as the helium gas is expanded at the low temperature end of the second step pulse tube 26B.

In this example, helium gas cooled by the first step cold storage device 22A and the first step pulse tube 26A is further cooled by the second step cold storage device 22B and the second step pulse tube 26B. Therefore, the temperature at the low temperature end of the second step pulse tube 26B, namely the temperature of the second step cold stage 28A, can be a cryogenic temperature such as approximately 4 Kelvin (K).

In the pulse tube cryogenic cooler 20B of the second embodiment of the present invention, the projection part 42 is provided at the low temperature end of the cold storage device cartridge 40, and the installing concave part 50 having a diameter smaller than the cold storage device cartridge 40 is provided-at the cold stage 28B.

Therefore, even if helium gas enters inside of the installing concave part 50, it is possible to make the force F2 small where the cold stage 28B and the first step cold storage device cylinder 30A are displaces by the helium gas. Because of this, it is possible to prevent deformation of the cold stage 28B and the first step cold storage device cylinder 30A. Hence, it is possible to prevent vibration in the pulse tube cryogenic cooler 20B.

The above-discussed pulse tube cryogenic coolers 20A and 20B of the first and second embodiments of the present invention can be applied to, for example, a superconducting apparatus, a cryopump, a cryogenic measuring and analyzing apparatus, and an NMR (nuclear magnetic resonance) apparatus, as a cryogenic cooler.

Thus, according to the above-discussed embodiment of the present invention, it is possible to provide a pulse tube cryogenic cooler, including a cold storage device cartridge whose high temperature end is connected to a pressure change source; a pulse tube whose low temperature end is connected to a low temperature end of the cold storage device cartridge via a stage member; a phase adjusting mechanism connected to a high temperature end of the pulse tube; a flange where the phase adjusting mechanism is provided; and a cold storage device cylinder provided between the flange and the stage member, the cold storage device receiving the cold storage device cartridge; wherein a projection part where a connection hole configured to connect with the pulse tube is formed is provided at the low temperature end of the cold storage device cartridge so as to project to the stage member; an installing concave part where the projection part is movably installed is formed in the stage member; and a cross-sectional area of the installing concave part is smaller than a cross-sectional area of the cold storage device cartridge.

Since the projection part where the connection hole configured to connect to the pulse tube is provided at the low temperature end of the cold storage device cartridge and the installing concave part where the projection part is movably installed is formed in the stage member, a part where the pressure of the operation gas in the cold storage device cartridge is applied to the stage member is a bottom surface of the installing concave part.

Because of this, the area where the pressure of the operation gas is applied to the stage member in the embodiments of the present invention is smaller than the area (the cross-sectional area of the cold storage device cartridge) where the operation gas is applied to the stage member in the related art.

Therefore, the force for displacing the operation stage 28 is small and thereby it is possible to prevent the vibration in the pulse tube cryogenic cooler.

In the above-mentioned pulse tube cryogenic cooler, a gap part may be provided between a container main body and the cold storage device cartridge; and the gap may be larger than a relative displacement between the container main body and the cold storage device cartridge.

Even if the cold storage device cylinder and the stage are relatively displaced from the cold storage device cartridge by the operation gas at the time of operation, this displacement is absorbed in the gap part. Therefore, the cold storage device cartridge and the container main body do not interfere with each other.

In the above-mentioned pulse tube cryogenic cooler, a piston ring may be provided at least one of the projection part and the installing concave part.

Since the piston ring is provided, it is possible, with a simple structure, to operate while a sealing state of the lower temperature end of the cold storage device cartridge and the stage member is maintained.

According to the above-discussed embodiment of the present invention, it is possible to provide a superconducting apparatus including the pulse tube cryogenic cooler discussed above, a cryopump including the pulse tube cryogenic cooler discussed above, a cryogenic measuring and analyzing apparatus including the pulse tube cryogenic cooler discussed above, and a nuclear magnetic resonance apparatus including the pulse tube cryogenic cooler discussed above.

The present invention is not limited to these embodiments, but variations and modifications may be made without departing from the scope of the present invention.

What is claimed is:

1. A pulse tube cryogenic cooler, comprising:

a cold storage device cartridge whose high temperature end is connected to a pressure change source;

a pulse tube whose low temperature end is connected to a low temperature end of the cold storage device cartridge via a stage member;

a phase adjusting mechanism connected to a high temperature end of the pulse tube;

a flange where the phase adjusting mechanism is provided; and a cold storage device cylinder provided between the flange and the stage member, the cold storage device receiving the cold storage device cartridge;

wherein a projection part where a connection hole configured to connect with the pulse tube is formed is provided at the low temperature end of the cold storage device cartridge so as to project to the stage member;

an installing concave part where the projection part is movably installed is formed in the stage member; and a cross-sectional area of the installing concave part is smaller than a cross-sectional area of the cold storage device cartridge, wherein a gap part is provided between a container main body and the cold storage device cartridge; and the gap is larger than a relative displacement between the container main body and the cold storage device cartridge.

2. The pulse tube cryogenic cooler as claimed in claim 1, wherein a piston ring is provided at at least one of the projection part and the installing concave part.

3. The pulse tube cryogenic cooler as claimed in claim 1, wherein a piston ring is provided at at least one of the projection part and the installing concave part.

4. A superconducting apparatus, comprising:

the pulse tube cryogenic cooler as set forth in claim 1.

5. A cryopump, comprising:

the pulse tube cryogenic cooler as set forth in claim 1.

6. A cryogenic measuring and analyzing apparatus, comprising:

the pulse tube cryogenic cooler as set forth in claim 1.

7. A nuclear magnetic resonance apparatus comprising:

the pulse tube cryogenic cooler as set forth in claim 1.

* * * * *